US012798824B2

(12) United States Patent
Too-Chiobi et al.

(10) Patent No.: US 12,798,824 B2
(45) **Date of Patent: *Nov. 17, 2026**

(54) SEPARABLE MODULAR CONTAINER

(71) Applicants: Alonna Too-Chiobi, College Station, TX (US); Chukwubuikem Ewelike, College Station, TX (US)

(72) Inventors: Alonna Too-Chiobi, College Station, TX (US); Chukwubuikem Ewelike, College Station, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/464,637

(22) Filed: Sep. 11, 2023

(65) Prior Publication Data

US 2023/0415953 A1 Dec. 28, 2023

Related U.S. Application Data

(63) Continuation of application No. 17/318,249, filed on May 12, 2021, now Pat. No. 11,753,203.

(51) Int. Cl.
*B65D 5/54* (2006.01)

(52) U.S. Cl.
CPC ..... *B65D 5/5495* (2013.01)

(58) Field of Classification Search
CPC ..... B65D 2571/00864; B65D 5/009; B65D 75/42; B65D 5/5495; B65D 2301/10
USPC ..... 229/120.011; 206/820; 220/23.83, 23.4, 220/23.2
See application file for complete search history.

(56) References Cited

U.S. PATENT DOCUMENTS

| | | | | |
|---|---|---|---|---|
| 4,214,659 | A * | 7/1980 | Jaeschke | B65D 5/5014 206/476 |
| 4,712,688 | A * | 12/1987 | Lambert | B65D 5/5495 229/164 |
| 5,291,990 | A * | 3/1994 | Sejzer | B65D 75/42 206/820 |
| 5,772,110 | A * | 6/1998 | Garretson | B65D 5/009 229/120.08 |
| 6,244,501 | B1 * | 6/2001 | Choi | B65D 5/009 229/162.6 |
| 7,389,908 | B2 * | 6/2008 | Cohen | B65D 5/008 229/116 |
| 7,537,121 | B2 * | 5/2009 | Markson | B65D 73/0078 206/745 |
| 10,692,404 | B2 * | 6/2020 | Ho | B65D 5/0254 |
| 11,224,822 | B2 * | 1/2022 | Kolev | A63H 33/08 |
| 11,472,597 | B1 * | 10/2022 | Wigington | B65D 5/48002 |
| 2016/0130060 | A1 * | 5/2016 | Ball | B65D 5/0227 229/126 |

* cited by examiner

*Primary Examiner* — Christopher R Demeree

(57) ABSTRACT

Separable modular container and methods of manufacturing the same are herein disclosed. The separable modular container generally includes a plurality of packages formed from a single die-cut panel. The packages formed from the single die-cut panel are detachable from one another.

19 Claims, 2 Drawing Sheets

SEPARABLE MODULAR CONTAINER

FIELD

Embodiments generally relate to separable modular containers of packages.

BACKGROUND

The retail pharmacy setting is a place rife with regulations and procedures designed to protect not only the pharmacy patients but also the pharmacy itself and the insurance providers that cover the large majority of the cost of the medications provided to the patients. Chief among the many concerns that are part of every transaction carried out daily in the pharmacy is safety. Before patients receive their medications, the pharmacy staff must process their prescription, which goes through several sets of safeguards and eyes. The purpose of these procedures is to ensure the safety of the patient. The protection these safeguards and procedures provide to the pharmacy itself and insurance providers is of a more financial nature.

These procedures in place to protect patient safety may include ensuring that the medication dispensed is the correct medication prescribed by the physician, ensure that the medicine does not negatively interact with other medicines the patient may currently be taking, ensure that the medication does not contain an ingredient that the patient is known to be allergic too, to counsel the patient concerning the medication and answer any questions they may have, and to ensure that the quantity the patient receives is the correct amount. Each prescription includes an information sheet that lays out potential side effects and the proper course of administration for each medication. Medications that are meant to be dispensed in the original sealed container, such as insulin, creams or lotions, and sealed pill containers with specified quantities and dosing directions, all come with a medication information sheet in the sealed container. This class of medications that are meant to be dispensed in their sealed container also ensures to the patient that the medication has not been tampered.

These safeguards are also in place to protect the pharmacy from making a mistake when dispensing medications to the patients, which could result in injury to the patient and financial loss to the pharmacy. Pharmacies typically have two or three people count the medication to be given out before it even reaches the cashier's counter. Should the pharmacy underfill the prescription (i.e. give less medication than prescribed), the patient may face health issues related to not having enough medication. However, if the pharmacy overfills the prescription (i.e. give more medication than prescribed), the pharmacy will lose money by not being reimbursed for the amount of medication given but not billed for. This is especially worrying for high-cost medications such as brand name medications and insulin. These safeguards further protect the pharmacy's potential financial loss from insurance providers.

One of the major concerns for insurance providers is being overbilled and overpaying for medications. One of the most frightening times in the pharmacy is being audited by an insurance provider. When an insurance provider audits a pharmacy, they examine a selection of prescriptions that they were billed for that they deem to be suspicious. If they find a discrepancy between what the original prescription says and what was billed, they will withhold payment to the pharmacy for that prescription. The result of this will be the pharmacy losing the profit from the prescription and the cost of the medication.

The confluence of all these concerns centers around insulin pens. Insulin pens typically come in packages of two to five pens. In a situation where the physician prescribes the patient a thirty-day supply of insulin pens where three pens are needed to last thirty days, but the insulin pens only come in sealed packs of five pens and the insurance provider covers no more than a thirty-day supply; what is the pharmacy to do? The pharmacy could dispense one box of five pens and bill the insurance provider for the five pens for thirty days. In this situation, the patient would receive more medication than would last the thirty days, and the insurance provider will be overpaying. Should the insurance provider find that they were overbilled for the thirty-day supply, they will withhold payment for that prescription. Another option for the pharmacy is to open the sealed package and dispense three pens and bill the insurance provider correctly. However, this option would conflict with the safeguards in place to protect the safety of the patient. The pens dispensed from the original package will no longer have the medication information sheet that is supposed to be given to the patient. This option also can no longer ensure to the patient that their medication has not been tampered with as it has been removed from the manufacturer's sealed packaging. The U.S. Food and Drug Administration has also issued opinions that pharmacies should refrain from opening sealed insulin pen packages, the most recent of which was published on Oct. 13, 2020. What is the pharmacy to do?

Therefore, there is a need for a package that provides the pharmacy with the needed flexibility to dispense off quantities of insulin pens and comport with the needs of the patient's safety and the financial protection to both the pharmacy and insurance provider.

SUMMARY

Embodiments generally include separable modular containers and methods for the manufacture of the same.

One or more embodiments generally include a separable modular container. The separable modular container includes a die-cut panel which forms a plurality of packages. The packages include a first terminal package and a second terminal package. The first and second terminal packages include a pair of vertical edges and a pair of horizontal edges. One horizontal edge of each terminal package is left uncoupled, and the other horizontal edge is coupled to another package within the die-cut panel.

One or more embodiments include the separable modular container of the preceding paragraph, wherein each package is formed of a semi-flexible material.

One or more embodiments include the separable modular container of any preceding paragraph, wherein each package is sealable.

One or more embodiments include the separable modular container of any preceding paragraph, wherein the container is formed of a single die-cut panel.

One or more embodiments include the separable modular container of any preceding paragraph, wherein the die-cut panel is folded at the tear feature to form the container.

One or more embodiments include the separable modular container of any preceding paragraph, wherein each package is sealed to retain a product inside.

One or more embodiments include the separable modular container of any preceding paragraph, wherein the tear feature is a score line.

One or more embodiments include the separable modular container of any preceding paragraph, wherein the tear feature is a perforated line.

One or more embodiments include the separable modular container of any preceding paragraph, wherein each package includes a top flap which is coupled to the top edge which allows for closing each package.

One or more embodiments include the separable modular container of any preceding paragraph, wherein each package includes a bottom flap which is coupled to the bottom edge which allows for closing each package.

One or more embodiments include the separable modular container of any preceding paragraph, wherein each package includes a side edge flap which is coupled to one of the vertical flaps.

One or more embodiments include the separable modular container of any preceding paragraph, wherein each package includes a length, width, and height. The height of the package being greater than the width and the length, while the horizontal edge is greater than the vertical edge for each package.

One or more embodiments include the separable modular container of any preceding paragraph, wherein each package includes substantially identical width, height, and length.

One or more embodiments include the separable modular container of any preceding paragraph, wherein the packages collapse onto each other to form a compact box.

One or more embodiments include the separable modular container of any preceding paragraph, wherein the container further includes a plurality of intermediate packages. Each intermediate package includes a pair of vertical edges and a pair of horizontal edges. Each horizontal edge of an intermediate package is coupled to another package within the die-cut panel. Each pair of horizontal edges further includes a top edge and a bottom edge. The tear feature is formed within the top each which allows for separation of each package from one another. The plurality of intermediate packages are coupled together in a repeating series such that the tear feature allows for separation between each intermediate package. The plurality of intermediate packages are positioned between the first and second terminal packages.

One or more embodiments include the separable modular container of any preceding paragraph, wherein the packages reside in a sequential queue in a line when stretched out.

One or more embodiments include the separable modular container of any preceding paragraph, wherein a single die-cut panel is folded to include the packages.

DETAILED DESCRIPTION

Introduction and Definitions

Figures 1A, 1B:
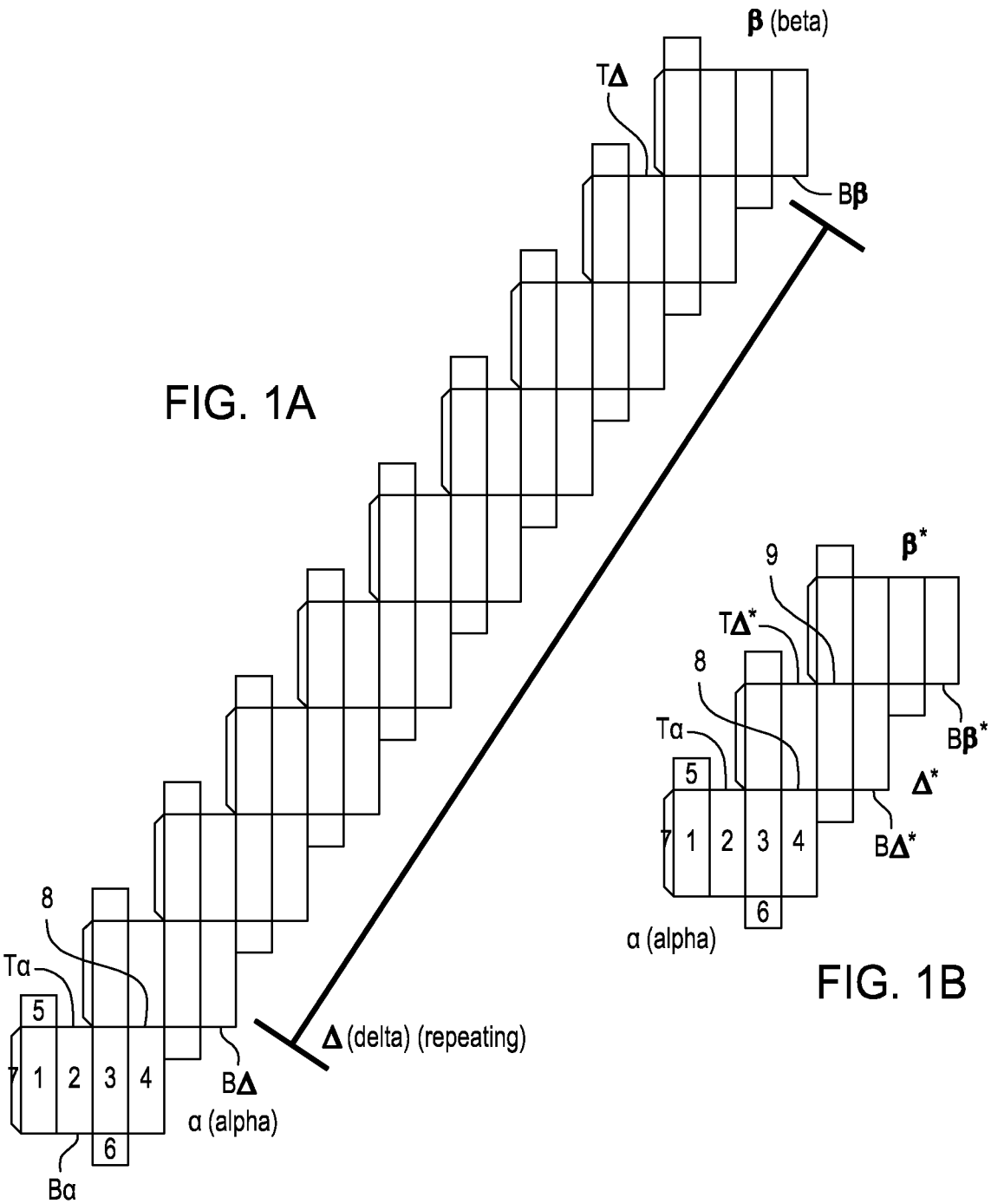
FIG. 1*a* is a die-cut panel plan illustrating how a container with a zig-zag chain can be cut.
FIG. 1*b* is a die-cut panel plan illustrating how a container with an offset zig-zag chain can be cut.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions when the information in this patent is combined with available information and technology.

Various terms as used herein are shown below. To the extent a term used in a claim is not defined below, it should be given the broadest definition skilled persons in the pertinent art have given that term as reflected in printed publications and issued patents at the time of filing. Further, unless otherwise specified, all compounds described herein may be substituted or unsubstituted and the listing of compounds includes derivatives thereof.

Further, various ranges and/or numerical limitations may be expressly stated below. It should be recognized that unless stated otherwise, it is intended that endpoints are to be interchangeable. Further, any ranges include iterative ranges of like magnitude falling within the expressly stated ranges or limitations.

Currently, pre-filled insulin syringes are provided to a pharmacy in a box of a set amount. Often, physicians will prescribe a number of syringes that are greater or less than are included in the pharmacy box. However, the pharmacy often cannot separate packages within a box. When a physician prescribes less insulin than what is provided in the sealed package, they must either open a federally mandated seal or another package or inaccurately bill the insurance provider. If the insurance provider learns of this, they will fine the pharmacy and withhold payment for the medication given. Thus, a packaging method is needed to allow the pharmacy to separate the accurate amount of pre-filled syringes.

Thus, one or more embodiments generally include separable modular containers manufactured in a manner to replace the conventional box as described above. The modular containers generally include a die-cut panel and a tear feature. Each separable modular container comprises packages used to surround a medical device that delivers a subcutaneous dose of medication. The separable modular container allows for customized dispensing of pre-filled insulin syringes and any medical device that delivers a subcutaneous dose of medication. Each package is connected to another by a tear feature on one or both ends by which each package is detachable from the others.

In one or more embodiments, the die-cut panel is used to form semi-flexible sealable packages. A die is a machine tool used to cut out a desired shape and profile within a piece of material. The die allows for the production of the same shapes with the same dimensions to be produced repeatedly. The die machine is what produces each single die-cut panel. A single die-cut panel is a long piece of material that can be folded along the cuts to create semi-flexible sealable packages. The semi-flexible sealable packages are easily formed and coupled together when created from the folding of the single die cut panel. The packages may be formed of a semi-flexible material. For example, the material may be selected from a material typically used for epi-pens packaging. For example, it may be formed from paperboard and combinations thereof. In one or more embodiments, the material of each package within a modular container is the same.

The container generally includes a first terminal package and a second terminal package. One of the horizontal edges of each terminal package is uncoupled, and the other horizontal edge is coupled to another package within the die-cut panel. In one or more embodiments, the horizontal edge is coupled to a horizontal edge of the other terminal package (e.g., the modular container includes two packages).

In one or more embodiments, the plurality of packages further includes intermediate packages. The number of intermediate packages in the modular container can be any number determined by a manufacturer. However, the number of intermediate packages may range from 1 to 100 or 2 to 50 or 3 to 25, for example.

Each package includes four-panel walls and a top and bottom closing flap that forms a rectangular prism. Each package is connected to another by a tear feature on one or both ends by which each package is detachable from the others.

The tear feature is disposed along a horizontal edge such that the tear feature provides for the separation of each package from one another. The packages can be coupled together by using the tear feature as the connecting point between each package. The coupling allows for easy storage and transportation of the semi-flexible sealable packages. The tear feature can be a score line that allows the packages to be separated into individual packages with the application of some force to the tear feature.

In one or more embodiments, each of the packages is sealable. An edge flap is connected to and pivots along the top edge of the separable modular container. The edge flaps are not restricted to any specific shape. When packages are constructed, the plane in which the edge flap resides can be oriented perpendicularly with respect to the panel walls of the package and can be sealed and held in such orientation by various methods. When such sealing is broken on the edge flap, it may then pivot freely, resulting in an opening of the package such that an item may be placed in, or removed from, the package. A secondary edge flap may be connected to and pivots along the bottom edge of the separable modular container.

With a modular package chain, the first terminal semi-flexible sealable package and the second terminal semi-flexible package create the two endpoints of a continuous chain of interconnected separable packages in a series that contains intermediate semi-flexible sealable packages located between the two terminal packages. Each package is both connected by and separable by a deposed tear feature that couples the packages together.

The intermediate semi-flexible sealable packages structurally have similar qualities as that of the terminal packages. However, the intermediate packages will possess a tear feature that is deposed along both the top edge and the bottom edge. The tear feature deposed on the top edge of the package is at a location that is offset relative to where the tear feature is deposed on the bottom edge of the package.

With reference to FIG. 1*a*, the embodiment shown illustrates a container including package α, package β, and a plurality of packages Δ. Each package has four package panel walls 1, 2, 3, and 4, a top flap 5, a bottom flap 6, and a side edge flap 7. Package α panel wall 4 top edge Tα possesses a tear feature 8 at the point where the adjacent package Δ panel wall 2 bottom edge BΔ is connected. This pattern of connecting points continues in the container for as many intermediate Δ packages that exist. The container ends with the package β that has panel wall 2 bottom edge Bβ connected to the adjacent package Δ panel wall 4 top edge TΔ. When packages are formed, there is no physical connecting point between the top of panel wall 3 and the bottom of panel wall 1 between each package. Top and bottom flaps 5 and 6 perform the function of providing a closeable or openable access point to the contents inside each package. The formed packages in FIG. 1*a* will create a zig-zag chain once assembled.

Figure 2:
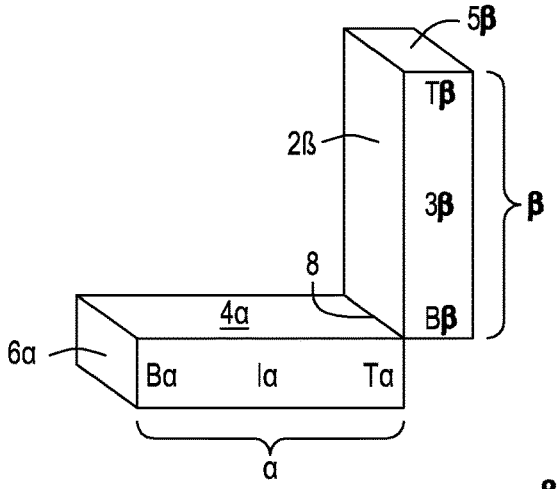
FIG. 2 shows a perspective view of a container including two packages connected together.

FIG. 2 illustrates a perspective view of a container, including package α and package β. Each package comprises of the same components as those mentioned in FIG. 1*a* above. As shown, when the packages are formed, the packages are connected and separable by a tear feature 8. This figure shows how package α panel wall 4α top edge Tα is connected to package β panel wall 213 bottom edge Bβ. Also shown in this illustration for package α is the side panel wall 1α and the bottom flap 6α. For package β is the side panel wall 313 along with top flap 513 that connects to panel wall 1β top edge Tβ, not shown.

The zig-zag chain that was represented by FIG. 1*a* is a series of multiple packages in which the connections between each package in the series is at the same numbered panel intersection of the packages such that when the packages are formed for storage purposes, the chain creates a zig-zag pattern replicated over and over.

Figure 3:
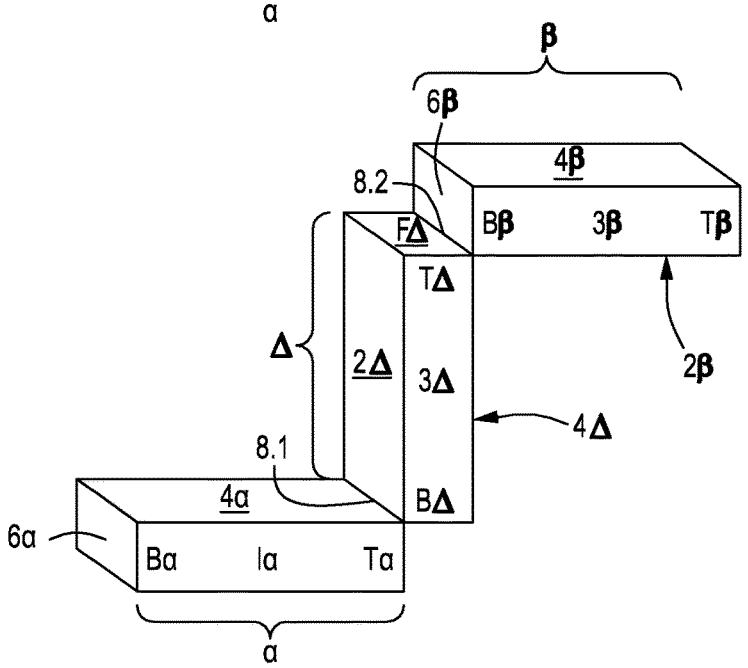
FIG. 3 shows a perspective view of a container including three packages connected together in a zig-zag chain.

FIG. 3 illustrates an example of a container with a zig-zag chain, including package α, package β, and package Δ. The illustration shows package α panel wall 4*a* top edge Tα connecting to package Δ panel wall 2Δ bottom edge BΔ via a tear feature 8.1. Then you have package Δ panel wall 4Δ (not shown) top edge TΔ connected to package β panel 2β (not shown) bottom edge Bβ via a tear feature 8.2. Also shown in this illustration for package α is the side panel wall 1α and the bottom flap 6α. For package Δ is the side panel wall 3A along with top flap 5Δ that connects to panel wall 1Δ (not shown) top edge TA. For package β are the side panel walls 3β and 4β along with bottom flap 6β that connects to panel wall 3β bottom edge Bβ. This figure shows a three-package container, but the number of packages in a container can be any plurality connected in a similar fashion.

With reference to FIG. 1*b*, the embodiment shown illustrates a three-package container possessing package α, β*, and Δ*. Each package has four package panel walls 1, 2, 3, and 4, a top flap 5, a bottom flap 6, and a side edge flap 7. In this figure, package α panel wall 4 top edge Tα possesses a tear feature 8 at the point where the adjacent package Δ* panel wall 2 bottom edge BΔ* is connected. Package Δ* panel wall 3 top edge TΔ* possesses a tear feature 9 at the point where the adjacent package β* panel wall 1 bottom edge Bβ* is connected. Between packages α and Δ*, there is no physical connecting point between package α panel wall 3 top edge Tα and package Δ* panel wall 1 bottom edge BΔ*. Similarly, between packages Δ* and β*, there is no physical connecting point between package Δ* panel wall 4 top edge TΔ* and package β* panel wall 2 bottom edge Bβ*. Top and bottom flaps 5 and 6 perform the function of providing a closeable or openable access point to the contents inside each package. The formed packages in FIG. 1*b* will create an offset zig-zag chain once assembled. The incongruous placement of tear feature 9 as compared to the placement of tear feature 8 between different packages establishes the offset once the packages are formed.

An offset zig-zag chain represents a series of multiple packages in which the connections between each package in the series is not at the same numbered panel wall intersection of the packages. The offset in the connection points creates a package chain that permits the ability to compress the packages into various dimensions or shapes for storage and transportation purposes.

Figure 4:
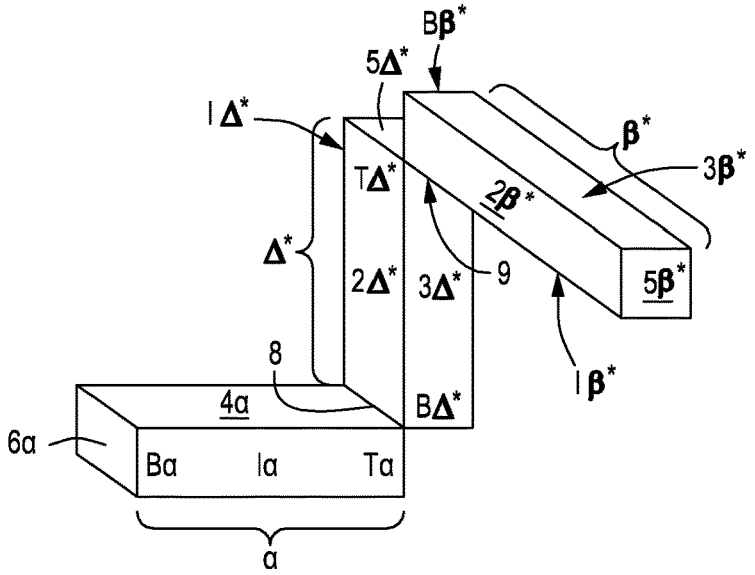
FIG. 4 shows a perspective view of a container including three packages connected together in an offset zig-zag chain.

FIG. 4 illustrates an example of a container with an offset zig-zag chain, including package α, package β*, and package Δ*. Package α panel wall 4α top edge Tα connecting to package Δ panel wall 2Δ* bottom edge BΔ* via a tear feature 8. Then package Δ* panel wall 3Δ* top edge TΔ* is connected to package β* panel wall β* bottom edge Bβ* via a tear feature 9 which creates the offset connection. Also shown in this illustration for package α is the side panel wall 1α and the bottom flap 6α. For package Δ* is the side panel wall 3Δ* along with top flap 5Δ* that connects to panel wall 1Δ* (not shown) top edge TΔ*. For package β* are the side panel walls 3β* and 2β* along with top flap 5β* that connects to side panel wall 1β* (not shown) top edge Tβ*.

While the foregoing is directed to embodiments of the present invention, other and further embodiments of the invention may be devised without departing from the basic scope thereof and the scope thereof is determined by the claims that follow.

What is claimed is:

1. A separable modular container comprising:

a die-cut panel including:

a plurality of packages, wherein a first package of the plurality packages includes:

a pair of horizontal edges, wherein a first horizontal edge of the pair of horizontal edges is uncoupled and a second horizontal edge of the pair of horizontal edges is coupled to a third horizontal edge of an adjacent package, wherein each additional package of the plurality of packages includes:

a pair of vertical edges; and a pair of horizontal edges, wherein a respective first horizontal edge of the pair of horizontal edges is coupled to a respective third horizontal edge of a respective adjacent package, and wherein one of the respective first horizontal edge or a respective second horizontal edge of the pair of horizontal edges includes a tear feature configured to separate each package of the plurality of packages from one another, wherein at least one package-to-package connection is formed at a first horizontal-edge connection point at a respective tear feature, the first horizontal-edge connection point being offset relative to a second horizontal-edge connection point of another package-to-package connection, such that at least a portion of the plurality of packages is foldable into a box, wherein each of the plurality of packages is configured to retain a subcutaneous dose of medication.

2. The container of claim 1, wherein each of the plurality of packages are formed of a semi-flexible material.

3. The container of claim 1, wherein each of the plurality packages are sealable.

4. The container of claim 1, wherein the container is formed of a single die-cut panel.

5. The container of claim 1, wherein the die-cut panel is folded at the tear feature to form the container.

6. The container of claim 1, wherein the tear feature is a score line.

7. The container of claim 1, wherein the tear feature is a perforated line.

8. The container of claim 1, wherein each of the plurality packages includes a top flap configured to close a respective package.

9. The container of claim 1, wherein each of the plurality packages includes a bottom flap configured to close a respective package.

10. The container of claim 1, wherein each of the plurality packages includes a side edge flap.

11. The container of claim 1, wherein each of the plurality packages includes a length, a width, and a height, with the height being greater than the width and the length, and wherein a horizontal length is greater than a vertical length for each package.

12. The container of claim 1, wherein the plurality packages collapse onto each other to form a compact box.

13. The container of claim 1, wherein each package of the plurality includes substantially identical width, height, and length.

14. The container of claim 1, wherein the packages reside in sequential queue in a line when stretched out.

15. The container of claim 1, wherein a single die cut panel is folded to comprise the packages.

16. A separable modular container comprising:

a die cut panel including:

a first package including a pair of vertical edges, and a pair of horizontal edges, wherein a first horizontal edge of the pair of horizontal edges is uncoupled and a second horizontal edge of the pair of horizontal edges is coupled to a third horizontal edge of a second package;

a second package including a pair of vertical edges, and a pair of horizontal edges, wherein the third horizontal edge of the pair of horizontal edges is coupled to the second horizontal edge of the first package and a fourth horizontal edge of the pair of horizontal edges is coupled to a fifth horizontal edge of a third package; and a last package including a pair of vertical edges, and a pair of horizontal edges, wherein a last horizontal edge of the pair of horizontal edges is uncoupled, wherein, each package includes one or more tear features to separate respective packages from one another, wherein at least one package-to-package connection is formed at a first horizontal-edge connection point at a respective tear feature, the first horizontal-edge connection point being offset relative to a second horizontal-edge connection point of another package-to-package connection, such that at least a portion of the plurality of packages is foldable into a box, wherein each of the plurality of packages is configured to retain a subcutaneous dose of medication.

17. The container of claim 16, wherein each package is formed of a semi-flexible material.

18. The container of claim 16, wherein the container is formed of a single die-cut panel.

19. The container of claim 16, wherein each package is sealable.

* * * * *